US007827777B2

(12) United States Patent
Eroglu et al.

(10) Patent No.: US 7,827,777 B2
(45) Date of Patent: Nov. 9, 2010

(54) COMBUSTOR WITH REDUCED CARBON MONOXIDE EMISSIONS

(75) Inventors: Adnan Eroglu, Untersiggenthal (CH); Oliver Riccius, Birmenstorf (CH); Klaus Knapp, Gebenstorf (CH); Peter Flohr, Turgi (CH)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 12/436,910

(22) Filed: May 7, 2009

(65) Prior Publication Data

US 2009/0282830 A1 Nov. 19, 2009

(30) Foreign Application Priority Data

May 15, 2008 (EP) ..... 08156297

(51) Int. Cl.
*F02C 3/00* (2006.01)

(52) U.S. Cl. ..... 60/39.37; 60/725; 60/737

(58) Field of Classification Search ..... 60/39.37, 60/722, 725, 737, 752, 798; 415/214.1; 431/174, 431/177, 154
See application file for complete search history.

(56) References Cited

U.S. PATENT DOCUMENTS

| | | | | |
|---|---|---|---|---|
| 2,601,612 | A * | 6/1952 | Imbert et al. | 60/39.37 |
| 3,657,883 | A * | 4/1972 | De Corso | 60/39.37 |
| 4,720,970 | A | 1/1988 | Hudson et al. | |
| 5,081,844 | A * | 1/1992 | Keller et al. | 60/737 |
| 5,297,385 | A | 3/1994 | Dubell et al. | |
| 5,901,549 | A | 5/1999 | Mandai et al. | |
| 5,983,643 | A * | 11/1999 | Kiesow | 60/746 |
| 6,430,930 | B1 * | 8/2002 | Andersson | 60/725 |
| 6,546,729 | B2 * | 4/2003 | Hellat et al. | 60/725 |
| 2004/0182085 | A1 | 9/2004 | Jeppel et al. | |
| 2009/0282830 | A1 | 11/2009 | Eroglu et al. | |

FOREIGN PATENT DOCUMENTS

| | | |
|---|---|---|
| DE | 4040745 | 7/1991 |
| DE | 4202588 | 7/1993 |
| DE | 4336096 | 5/1994 |
| DE | 4339094 | 5/1995 |
| EP | 1724526 | 11/2006 |
| GB | 2275738 | 9/1994 |
| WO | WO93/10401 | 5/1993 |
| WO | WO9812478 | 3/1998 |

OTHER PUBLICATIONS

Search Report for European Patent App. No. 08156297.7 (Nov. 8, 2007).
Search Report for European Patent App. No. 08156299.3 (Nov. 13, 2008).

* cited by examiner

*Primary Examiner*—Louis Casaregola
(74) *Attorney, Agent, or Firm*—Cermak Nakajima LLP; Adam J. Cermak

(57) ABSTRACT

A combustor arrangement for a gas turbine engine (31) has a split line (42) and a plurality of burners (20,37) arranged in an annular ring (40). The burners (46) of the combustor on either side of the split line (42) have a separation distance of at least two times the average separation distance between burners (48) distant from the split line (42).

5 Claims, 2 Drawing Sheets

COMBUSTOR WITH REDUCED CARBON MONOXIDE EMISSIONS

This application claims priority under 35 U.S.C. §119 to European patent application no. 08156297.7, filed 15 May 2008, the entirety of which is incorporated by reference herein.

BACKGROUND

1. Field of Endeavor

The invention relates to the design of an annular combustor of a gas turbine engine. More specifically the invention relates to a combustor design with reduced carbon monoxide emissions.

2. Brief Description of the Related Art

A gas turbine engine to which this invention can be applied is shown in FIG. 1 and has the following elements. A compressor 21 compressing air, for use in a high-pressure combustion chamber 22 is fitted with premix burners 20, as well as for cooling. Partially combusted air from the high-pressure combustor 22 passes through a high-pressure turbine 23 before flowing further into a low-pressure combustion 24 chamber where combustion occurs by self-ignition. In this chamber fuel is added to unburnt air from the high-pressure combustor 12 via a lance 37 that defines the burner of the low-pressure combustor 24. Both of the combustors include elongated toroidal shaped combustion chambers surrounding the shaft 30 of the engine and have their burners annularly mounted at one end of the chamber. The hot combustion gases then pass through a low-pressure turbine 25 before passing through a heat recovery steam generator. In order to generate electricity, the compressor 21 and turbines 23,25 drive a generator 26 via a shaft 30.

The burner of the high-pressure combustor is typically a pre-mix burner 20 as shown in FIG. 2. It typically includes a conical swirl shaped body in the form of a double cone 11 which is concentric with the burner axis, wherein the region between the double cone 11 body and burner axis defines a swirl space 17. A central fuel lance 12 lies within the burner axis extending into the swirl space 17. In a first stage 18, pre-mix fuel is injected radially into the swirl space 17 through injection holes in the fuel lance 12 while in a second stage 14, pre-mix fuel is injected through injection holes located in the double cone 11 section of the burner into an air stream conducted within the double cone 11.

In order to facilitate the inspection of a gas turbine engine, each of the combustors is separable along a split plane, forming a split line. The need to break the combustors at the split line means that the split line cannot be totally sealed, resulting in gas leakage of cooling gas from the plenum surrounding the combustor. This leakage results in localized cooling that extends to adjacent burners, resulting in greater formation of CO in these burners than in other burners. When the cooling gas is air, the localized cooling is coupled with increased oxygen concentration, exacerbating the problem.

CO is a restricted gas for emission purposes and so there is a desire to reduce its production. While operating parameters, such as combustor inlet and flame temperature, impact the formation of CO, due to the overriding need to drive engine throughput and efficiency it is undesirable to use these parameters as CO emission control parameters. There is therefore a need for an alternative.

SUMMARY

One of numerous aspects of the present invention includes a combustor with reduced CO emission.

Another aspect includes the general idea of increasing the burner separation distance in the vicinity of the split plain of a combustor.

Yet another aspect of the invention includes a combustor for a gas turbine engine having a split line and comprising burners arranged in an annular ring characterized by the separation distance between burners either side of the split line being at least two times the average separation distance between burners distant from the split line. The large separation distance reduces CO emissions caused by split line seal leakage. A further advantage is that, due to the significant disruption in the symmetry of the burner arrangement, thermo-acoustic stability is increased, enabling higher burner gas velocities and offsetting what would otherwise be a sub-optimal use of available combustor circumferential space.

In a further aspect, the separation distance of the burners either side of the split line is at least four times, but not more than seven times, the average burner separation distance distant from the split line, thus eliminating the impact of split line leakage on the turbine engine CO generating while not extending the distance beyond a point of benefit.

In another aspect, the combustor is the high-pressure combustor of a gas turbine engine and the burners are pre-mix burners, although principles of the invention could also be applied, for example, to the lances of the low-pressure combustor.

In a further aspect, to maximize thermo-acoustic stability, a thermo-acoustic pulsation suppression or dampening device is located between burners either side of the split line, thus efficiently and advantageously utilizing the space made available by the burner arrangement. In a further aspect, the burners either side of the split line are equidistant from the to optimize the separation distance from the split line. Where, however, for example, pulsation suppression devices are fitted towards one side of the split line, as these devices may provide some shielding of burners from leakage gas, the separation distance of burners from the split line on one side of the split line may preferably be different to those on the other side of the split line.

Another aspect of the invention includes overcoming, or at least ameliorating, the disadvantages and shortcomings of the prior art or providing a useful alternative.

Other aspects and advantages of the present invention will become apparent from the following description, taken in connection with the accompanying drawings wherein by way of illustration and example, an embodiment of the invention is disclosed.

BRIEF DESCRIPTION OF THE DRAWINGS

By way of example, an embodiment of the invention is described more fully hereinafter with reference to the accompanying drawings, in which.

DETAILED DESCRIPTION OF EXEMPLARY EMBODIMENTS

Figure 1:
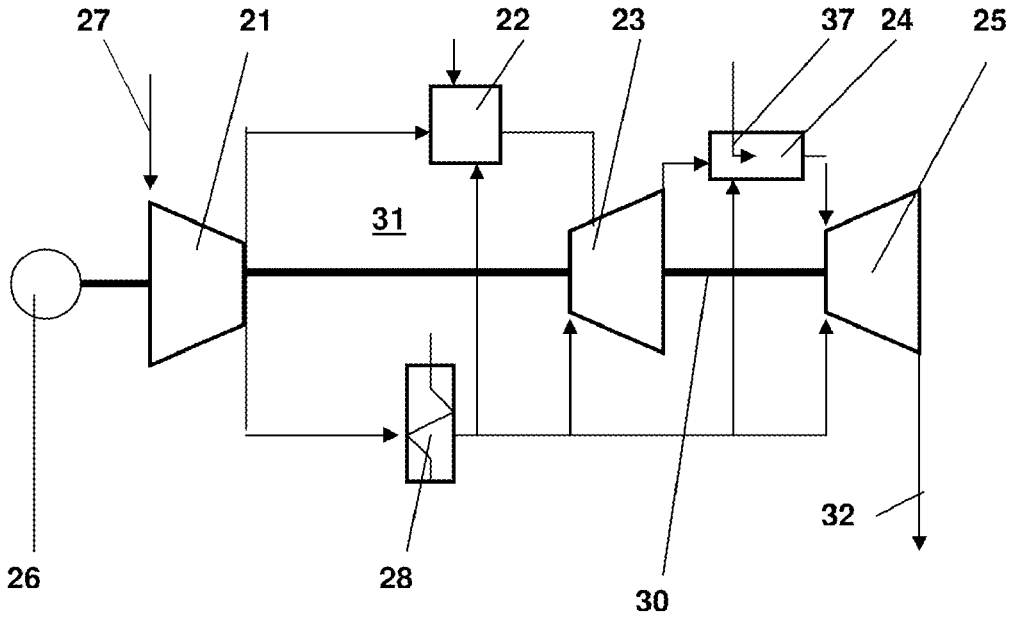
FIG. 1 (Prior Art)
FIG. 1 is a schematic view of a gas turbine engine.
Figure 2:
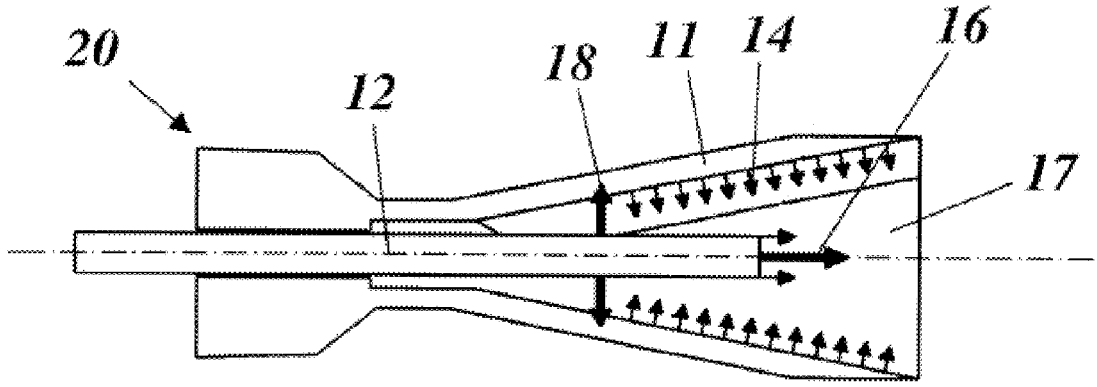
FIG. 2 (Prior Art)
FIG. 2 is a sectional cut away view of a staged premix burner.

Preferred exemplary embodiments of the present invention are now described with reference to the drawings, wherein like reference numerals are used to refer to like elements throughout. In the following description, for purposes of explanation, numerous specific details are set forth in order to provide a thorough understanding of the invention. It may be evident, however, that the invention may be practiced without these specific details.

Figure 3:
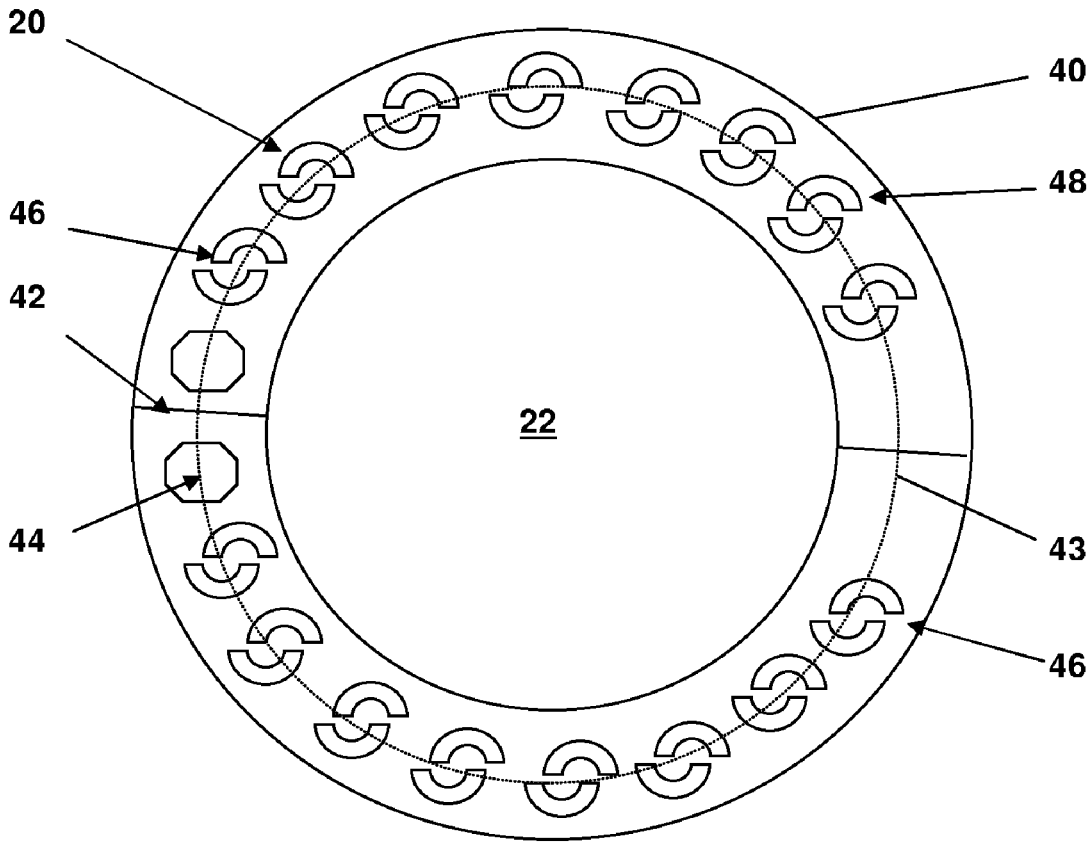
FIG. 3 illustrates a preferred arrangement in accordance with the invention showing a cross sectional end view of circumferentially mounted premix burners of FIG. 2 in a combustor of a gas turbine engine of FIG. 1.

As shown in FIG. 3, an embodiment is illustrated in which burners 46 either side of the split line 42 are located further apart than burners 48 distant from the split line 42 by a factor of at least two, but preferably by at least four, but less than seven, and are preferably spaced such that the split line 42 is approximately equidistant from these burners 46. The separation distance used to determine these factors throughout this specification is measured along an imaginary central arc 43 passing approximately through the axis of each burner, where, in addition, the axis of the burner is also the point of measure. The resulting thermo-acoustic stability resulting from the disrupted spatial symmetry enables higher burner gas rates, offsetting the disadvantage of a possible lower burner count as a result of the less efficient use of the combustor annular space 40.

While the invention is most applicable to the pre-mix burners 20 of a high-pressure combustor 22, as the flame front of this burner is relatively close to the burner tip, the invention can equally be applied to the lances 37 that include the burners of the low-pressure combustor 24.

Further the space around the split line 42 can be used to fit thermo-acoustic vibration suppression or dampening devices 44 such as a Helmholtz resonator.

Although embodiments exemplifying principles of the present invention have been herein shown and described in what is conceived to be the most practical and preferred embodiments, it is recognized that departures can be made within the scope of the invention, which is not to be limited to details described herein but is to be accorded the full scope of the appended claims so as to embrace any and all equivalent devices and apparatus.

REFERENCE NUMBERS

11. Double cone
12. Fuel lance
18. First stage
14. Second stage
16. Liquid fuel
17. Swirl space
20. Premix burner
21. Compressor
22. High-pressure combustor
23. High-pressure turbine
24. Low pressure combustor
25. Low-pressure turbine
26. Generator
27. Air
28. Air cooler
30. Shaft
31. Gas turbine engine
32. Exhaust gases
37. Low pressure combustor lance
40. Combustor annulus
42 Combustor split line
43. Central arc
44. Thermo-acoustic vibration suppression or dampening device
46. Burner on one side of the split line
48. A burner distant from the split line While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A combustor for a gas turbine engine, the combustor comprising:

a split line formed along a split plane along which the combustor is separable; and a plurality of burners arranged in an annular ring;

wherein a separation distance between adjacent burners on either side of the split line is at least two times the average separation distance between adjacent burners distant from the split line.

2. The combustor of claim 1, wherein the separation distance between said adjacent burners on either side of the split line is at least four times, but less than seven times, the average the separation distance between adjacent burners distant from the split line.

3. The combustor of claim 1, wherein the combustor comprises a high-pressure combustor of a gas turbine engine and the burners comprise premix burners.

4. The combustor of claim 1, further comprising:

a thermo-acoustic pulsation suppression or dampening device located between adjacent burners on either side of the split line.

5. The combustor of claim 1, wherein said adjacent burners on either side of the split line are equidistant from the split line.

* * * * *